US005360505A

United States Patent [19]

Schulz et al.

[11] Patent Number: 5,360,505

[45] Date of Patent: Nov. 1, 1994

[54] DOOR FOR A SINGLE-FACE STATION OF A MACHINE THAT PRODUCES CORRUGATED CARDBOARD

[75] Inventors: Jens Schulz, Hamburg; Martin Hoffmann, Tangstedt; Nicolaus Goerrissen, Elmshorn, all of Germany

[73] Assignee: Peters Maschinenfabrik, Hamburg, Germany

[21] Appl. No.: 78,047

[22] Filed: Jun. 18, 1993

[30] Foreign Application Priority Data

Jun. 19, 1992 [CH] Switzerland ..... 01937/92-8

[51] Int. Cl.[5] ..... B31F 1/28

[52] U.S. Cl. ..... 156/382; 156/472; 156/473; 220/316; 220/324; 292/26

[58] Field of Search ..... 156/473, 382, 205, 210, 156/470, 471, 472; 220/316, 324, 325; 292/26, 48, 97

[56] References Cited

U.S. PATENT DOCUMENTS 2,970,718 2/1961 Jennings, Jr. ..... 220/316
3,844,597 10/1974 Elrod et al. .
4,941,695 7/1990 Miller .
5,110,396 5/1992 Harris ..... 156/382
5,145,549 9/1992 Mosburger ..... 156/472 X
5,160,400 11/1992 Thomas ..... 156/382

*Primary Examiner*—Michael W. Ball
*Assistant Examiner*—Michele K. Yoder
*Attorney, Agent, or Firm*—Hill, Steadman & Simpson

[57] ABSTRACT

A vertical rear door for a single-face station which has a pressurized volume and which station is used to produce corrugated cardboard. The door consists of a panel with an outer dimension slightly smaller than the inner dimensions of the door frame in which it is received. The whole periphery of the panel of the door is provided with peripheral seals resting on the inner periphery of the framework. An interlocking arrangement includes at least a hook mounted to extend in a vertical plane from the inner surface of the panel of the door and liftable so that it can move in a vertical plane by means of a lifting arrangement. The hook engages an interlocking axle which is mounted permanently on the door frame and the front part of the inner notch of the hook has a forward curvature to surround a substantial portion of the axle when the hook is engaged thereon. The hook also has a front cam surface which will cause lifting of the hook to allow it to ride up over the axle until the inner notch is received on the axle during closing of the door.

6 Claims, 3 Drawing Sheets

DOOR FOR A SINGLE-FACE STATION OF A MACHINE THAT PRODUCES CORRUGATED CARDBOARD

BACKGROUND OF THE INVENTION

The present invention is directed to a door for a single-face station of a machine that produces corrugated cardboard and, particularly, to a rear door which is fitted on rails and closes an inner volume of the single-face station in such a way that the volume can be placed under pneumatic pressure.

Usually, a single-face station is located upstream of the machine that produces the cardboard. A first web is corrugated, when it travels between two corrugating rolls of the single-face station, and then receives glue on the crest of the flutes of the corrugations while the corrugated sheet is on the lower of the two corrugating rollers from a gluing unit. Then, a second covering sheet is applied by a third lower pressure roll onto the crest of the flutes that have been provided with glue.

The frame of such a station comprises a stand with two lateral walls, whose front edges support the two corrugating rolls and the lower pressure roll, which make up, in a certain way, a front wall. The gluing unit, whose front glue-applying roll is brought at a very precise distance close to the rear lower part of the second lower corrugating roll, is located between the two lateral walls. This gluing unit is usually mounted on rails in order to be taken out from the back of the station for cleaning, maintenance and repair, as well as to allow an easy access to the rolls from the back for similar operations.

A recent technique for keeping the corrugating web perfectly applied against the flutes of the rear part of the second corrugating roll where the gluing operation takes place consists in closing the upper part of the station by means of a plate, as well as a rear side by means of a door, and to pressurize the inner volume thus defined with a pneumatic pressure of, say, 50 to 60 millibars. Obviously, this door is to be reopened for the gluing unit to be taken out, if necessary, which fact causes the double problem of interlocking and sealing of the door.

A rear door of a single face station is known to be fitted on a pair of rails for an orthogonal translation and, with analogy to the doors of a bank safe, has a first front part with dimensions slightly smaller than the openings of the framework and a rear rim with a larger dimension. The first part of this door is completed with a series of latches situated in a vertical plane and which are meant to penetrate into orifices machined in the inner section of the opening. The vertical front sides of the rear rim are provided with elastomer tightening seals which engage on the rear side of the framework of the opening. Thus, when the door is shut, it is necessary to first push it against the framework in order to squeeze the tightening seal and to bring the latches in correspondence with the openings prior to the turning of the handle in order to engage these latches. The shutting process is difficult for an operator, especially due to the use of mechanical devices for gearing down the actuation of the latches. In fact, the existence of the mechanical gearing-down device allows for disengagement of the latches, although an overpressure still exists in the inner volume. It is, therefore, necessary to foresee an auxiliary independent security device in order to prevent a manipulation error which is liable to create a dangerous situation for the operator, which is the pressure still in the inner volume.

SUMMARY OF THE INVENTION

An object of the present invention is to provide a single-face station with a door, which incorporates a safety device for the opening process in the event of a remaining overpressure within the inner volume of the single-face station. Moreover, the interlocking system has to be of a simpler use for the opening process as much as for the shutting process. Finally, it would be appreciated to have the tightening device, which, in fact, supports only a feasible pneumatic overpressure, of a more reliable conception and, particularly, unsensitive with regard to the final position of the door in the framework.

To accomplish these goals, the present invention is directed to an improvement in a single-face station having a frame with side walls supporting corrugating rolls and a pressure roll at one end and having a rear door opposite the corrugating rolls received in a door frame to enclose an inner volume which receives a gluing unit that rides on rails secured to the door. The improvement comprises the door consisting of a panel with outer dimensions slightly smaller than the inner dimensions of the door frame which receives the door, the periphery of the section of the panel having a thickness different from the one of the door frame and being provided with a peripheral tightening seal resting on an inner periphery of the door frame, the rails being mounted on an inner surface of the panel to extend perpendicular to the plane of the panel, the rails being arranged to slide on runners arranged on the stand of the frame of the station and being provided at one end with stopping pieces designed to limit the backward or opening motion of the door when the pieces contact stops provided on the stand, the door having interlocking means including at least one interlocking axle permanently mounted in the door frame and a hook mounted to extend perpendicular to the plane of the inner surface of the panel of the door to cooperate with the axle, said hook being mounted for pivotable movement in a vertical plane, means provided on the panel for pivoting the hook in a vertical direction between an engaging position on the axle and a disengaging position, and the hook having an inner notch engaging the interlocking axle with a front part having a curvature directed toward the panel.

Owing to the arrangement of the panel, the framework and the tightening seals, the door can slide a little over a distance of 3 or 4 centimeters into the frame like a piston in a cylinder without losing its seal. On the contrary, the curvature of the front part of the inner notch of the hook is directed toward the side of the panel and implies that the door is imparted a slight backward motion when the inner volume is set under pressure. This will act to make it impossible for lifting the hook off of the axle, as long as this overpressure has not been completely dissipated. The disengagement of the hook from the axle is only possible once the door can move forward again into the chamber.

The tightening seal may consist of a more or less hollow pad of elastomer or flexible plastic or else of a series of longitudinal rollers pushed back by inner pull-back means or by any type of seal sufficiently squeezable so as to allow the panel to be inserted into the framework without difficulty. However, it has been found that the preferred embodiment is for the seal to consist of fitting brushes along the periphery of the door in such a way that their bristles will protrude outwardly from the panel.

Usefully, the lower front part of the hook may be orientated obliquely downward in order to provide a lifting cam surface which will automatically engage the interlocking axle, which is mounted permanently in the framework of the frame of the station, and cause the hook to rise when it first engages the interlocking axle during the shutting process. Thus, the hook will ride up over the axle until the axle is positioned to be received in the notch.

Advantageously, the door includes a hook on each side for a better separation of the holding effort, and the means for pivoting the hook comprises, then, a horizontal axle mounted for rotation in bearings on the inner surface of the door. This horizontal axle is then linked on each end to the hooks to impart to them an upward and downward rotary motion.

In an even better way, the door may include a vertically-spaced pair of hooks on each side, and the lower and upper hooks of each pair are connected by means of a vertical bar. The horizontal axle of the means for pivoting the hooks is then linked to each vertical bar by an arm, so that the vertical bars are shifted as the horizontal axle is rotated.

It is envisioned to turn the horizontal axle of the means for pivoting the hooks direct by means of a lever extending through a slit provided with brush seals. However, a better device comprises a central arm almost vertical and permanently mounted on the horizontal axle of the means for pivoting the hooks, and the other end of this central arm being rotatably connected to a horizontal control lever extending through the door. This control lever effects only a lengthwise translational movement and can, thus, extend through the door through a simple orifice which diminishes greatly the problems with pressure loss.

Other advantages and features of the invention will be readily apparent from the following description of the preferred embodiments, the drawings and claims.

DESCRIPTION OF THE PREFERRED EMBODIMENTS

Figure 1:
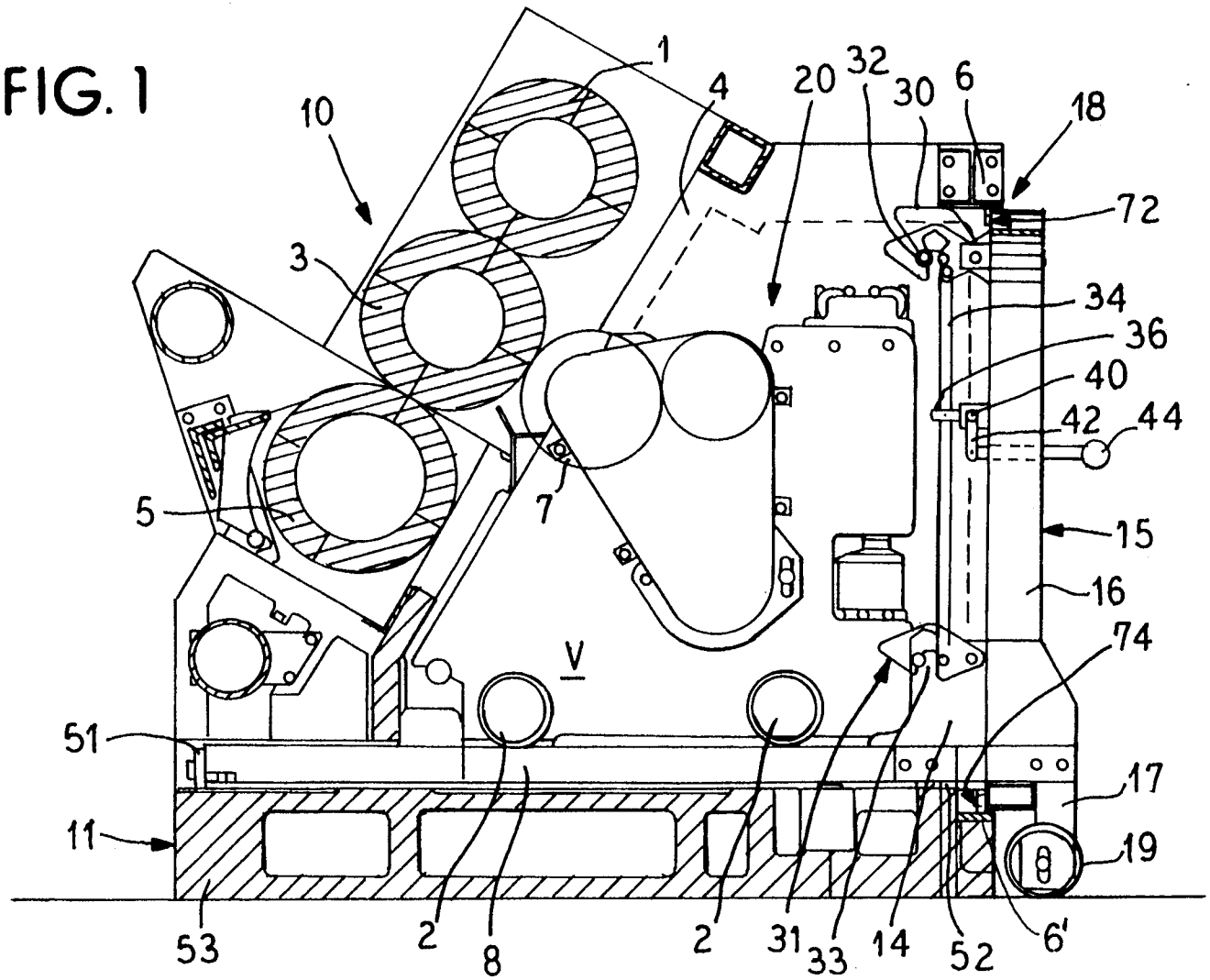
FIG. 1 is a lengthwise cross sectional view of a single-face station provided with a door according to the present invention.

The principles of the present invention are particularly useful when incorporated into a single-face station, generally indicated at 10 in FIG. 1. The station 10 has a frame, generally indicated at 11, which includes a stand 53 and two lateral side walls 4. In a front part or, as illustrated in FIG. 1, the left-hand corner, the frame supports an upper corrugating roll 1, a lower corrugating roll 3, together with a pressure roll 5. The frame of the station is closed along the top by a coverage and is provided with a rear framework or door frame 18 which receives a door 15 and is limited at the top by a crossbar 6 and on either side by rear edges of the lateral walls 4 and at the bottom by a horizontal plate 6'. These various components make up an inner volume V of the single-face station 10. A gluing unit, generally indicated at 20, is positioned in this inner volume V and has a front glue-applying roller 7, which is almost in contact with the rear part of the lower corrugating roll 5. The gluing unit 20 has rollers or wheels 2 which rest on rails 8 of the closing door 15.

Figure 2:
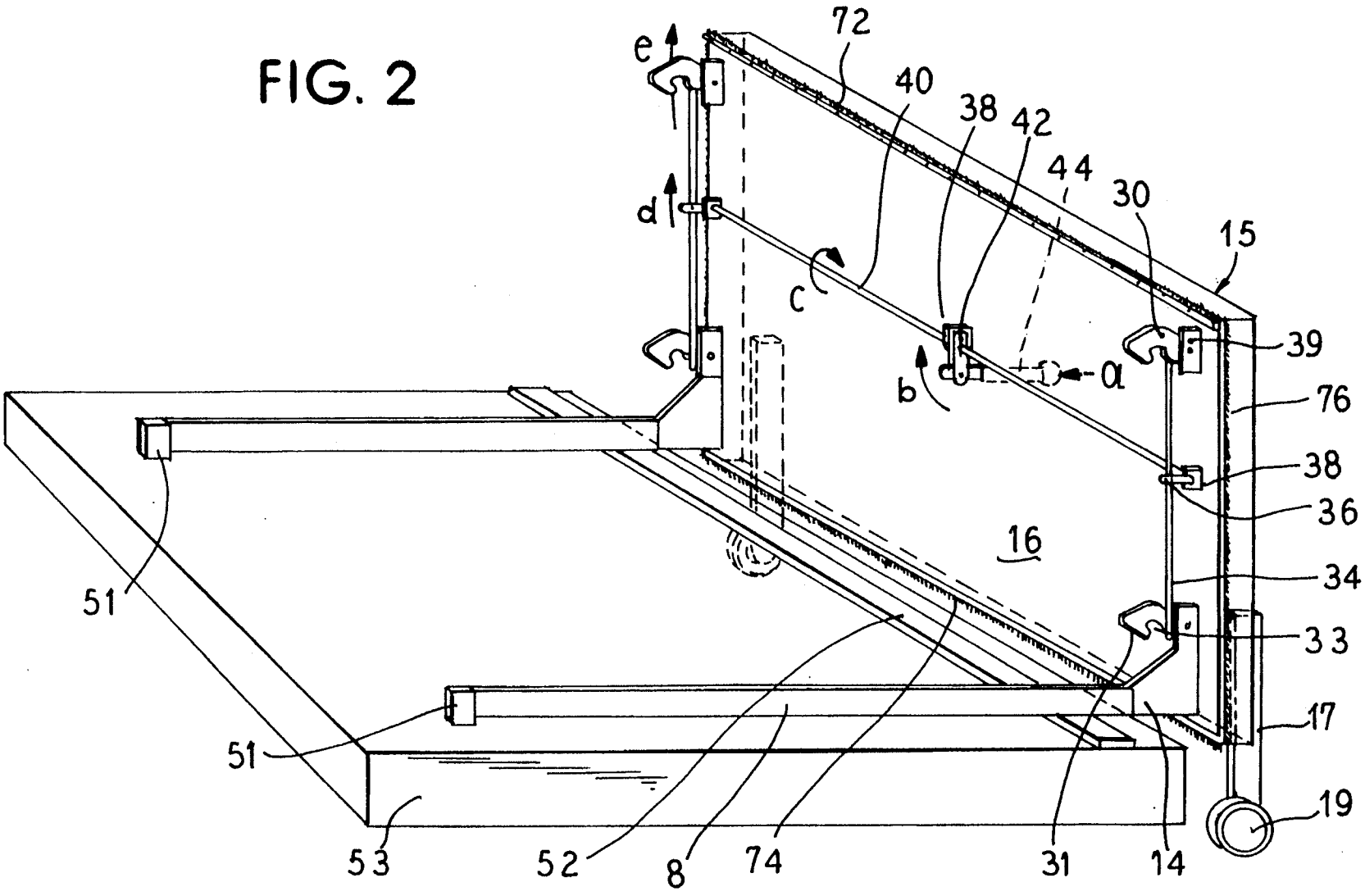
FIG. 2 is a perspective view of the door showing in detail the device of the lifting hooks.

As best illustrated in FIGS. 1 and 2, the back closing door 15 essentially consists of a panel 16 which, on a back surface, is provided with cross-pieces 17 which support rollers or wheels 19. The panel 16 is provided with square pieces 14 which support the rails 8, which are arranged in such a way as to slide in runners arranged on the stand 53 of the frame 11 of the station 10. Each of the rails 8 is provided with a stop 51 which engages a stop 52 provided on the stand 53 to limit the amount of opening of the door 15.

As may be seen from FIG. 1, the outer dimensions of the panel 16 of the door 15 are slightly smaller by an amount of 5 to 10 millimeters than the inner dimensions of the rear framework or door frame 18 of the above-mentioned frame 11. To form a seal between the pneumatic overpressure existing inside of the inner volume V of the single-face station 10 and the outer atmosphere, a series of seals including an upper horizontal brush 72, two lateral brushes 76 and a lower brush 74 are provided. These brushes are secured either by screws or rivets to an outer periphery of the panel 16 of the door 15 and the bristles of the upper brush 72, the lower brush 74 and the lateral brushes 76 are orientated to extend outwardly, as illustrated in FIG. 2. Advantageously, these brushes are made of nylon fibers having a sufficient rigidity, even after long use.

Figure 3:
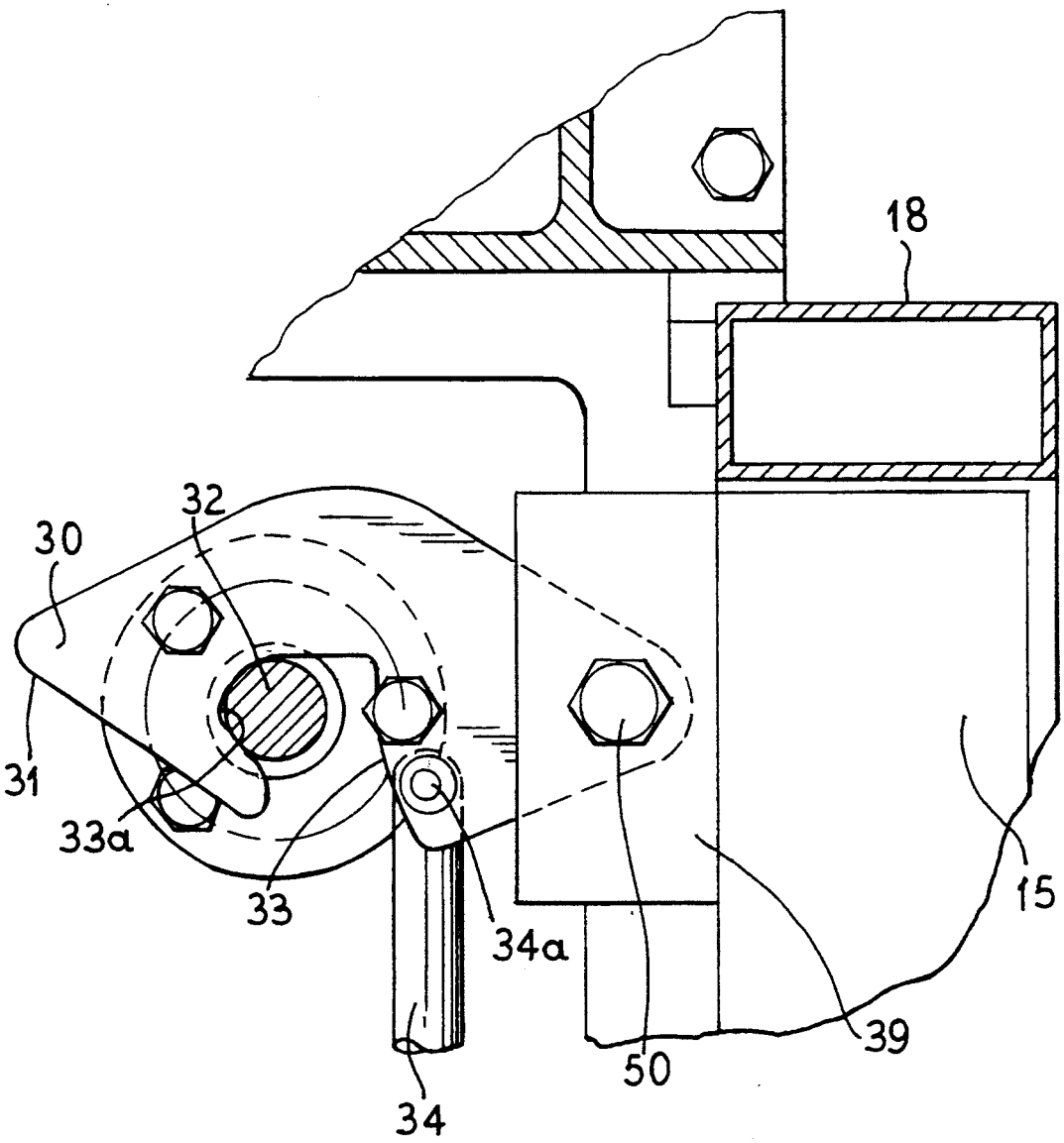
FIG. 3 is an enlarged side view of one of the hooks of the present invention.

As illustrated in FIG. 2, the means for interlocking the door 15 includes four hooks 30 which are arranged in two lateral pairs along the sides of the panel 16 with each of the hooks being fitted almost in the vicinity of the corner of the panel of the door. As illustrated in FIG. 3, every hook is mounted on a support 39, which is orientated to extend perpendicularly in a vertical plane from the door 15 so that the hook is able to rotate in a vertical plane around a pivot 50. The hooks 30 of a lateral pair, such as illustrated in FIG. 2, are interconnected by means of a vertical bar 34, whose ends are connected to each of the hooks by a rotational pivot **34*a* (FIG. 3**).

Moreover, the two pairs of hooks 30 connected by the vertical bars 34 are also coupled by means of a horizontal axle 40 (FIG. 2), which is mounted on the inner surface of the panel 16 of the door 15 by bearings 38. Under the circumstances, a simple plate perforated and welded onto the panel will act as the bearing 38. Each end of the axle 40 is completed with an almost horizontal arm 36, whose ends are connected by a pivot to the corresponding vertical bar 34.

This horizontal axle 40 is also completed with a central arm 42, preferably extending downwardly, as illustrated in FIG. 2, and whose end is also connected by means of a pivot to a control lever 44, which extends horizontally through a slot in the panel 16 of the door 15. The slot or orifice has dimensions which are just sufficient for the translation of movement of this lever and, thus, will provide no or small pneumatic pressure losses.

As may be gathered from FIGS. 1 and 3, every hook 30 has an inner notch 33 meant to engage on an interlocking axle 32 situated correspondingly on a lateral wall 4 of the frame 11 of the station 10. More specifically, a front part **33*a* of the inner notch 33 has a strong forward curvature so that once the hook 30 is engaged on the axle 32 and the door is pushed backward by the overpressure existing in the chamber 3, these hooks 30 surround substantially entirely the interlocking axle 32 and cannot be lifted directly therefrom. This arrangement stops any premature opening of the door 15**.

Moreover, a lower front surface or edge 31 of every hook 30 is orientated obliquely downward with the upper part higher than the interlocking axle 33. As may be easily understood, the shutting process of the door 15 is particularly easy, since once the gluing unit 20 has been slid into the station 10, there is only the door 15 to be pushed with the rails sliding on their runners situated in the frame 11 until the hooks 30 will meet the interlocking axles 32. In view of the oblique front edge or part 31 which forms a cam surface for these hooks 30, the hooks will be raised automatically until the inner notch 33 is positioned over the axle 32 to allow the hook to drop by its own weight downward with the axle 32 received in the notch.

In the course of this forward motion, the door 15 will penetrate into the framework 18 and the brushes 72, 74 and 76 will rest or engage on the corresponding inner surfaces of the framework or door frame 18, for example with the lower brush 74 on the plate 6', the upper brush 72 on the crossbar 6 and the lateral brushes 76 on each of the walls 4. This penetration process is assisted by the inertia occurring from the overall mass of the door 15.

When the pneumatic overpressure is applied in the station 10, the door will effect a slight backward motion of approximately 1 centimeter, which amount corresponds to the inner curvature or recess 33*a* of each of the hooks 30. This backward motion will not impair the sealing caused by the brushes, which will have slid along the same distance with regard to the corresponding inner surfaces of the door frame 18 in the way of a piston equipped with a ring will move in a cylinder.

When the door 15 is to be opened, it is necessary that a complete reestablishment of atmospheric pressure in the station 10 be obtained, otherwise it is impossible to push the door inward to disengage the hooks from the shafts or axles 32. In fact, the force resulting from the overpressure on the entire surface of the door is far too important to allow such a process. It is, hence, impossible for the operator to open the door before the atmospheric pressure is completely re-established in the station 10. When the atmospheric pressure is established in the station, it is possible to push the door 15 forward and to act on the control lever 44, as illustrated in FIG. 2, owing to a movement in the direction of the arrow a. This movement of the lever 44 in the direction of arrow a will imply a rotation shown by the arrow b on the central arm 42 to rotate the axle 40 in the direction of arrow c. The rotation of the axle in the direction of arrow c will cause a lift in the direction shown by the arrow d for the two vertical bars 34 to finally lift each of the hooks by pivoting them in the direction of arrow e. Only at that time can the door 15 be pulled back and opened.

As may have been understood from the reading of this description, the relatively simple conception of the interlocking and sealing system of this door 15 insures a safe use of the machine if overpressure remains in the station 10 by stopping a premature opening process of the door. The arrangement also allows an easy and safe shutting of the station by a simple pushing of the door 15 to the closed position.

Although various minor modifications may be suggested by those versed in the art, it should be understood that we wish to embody within the scope of the patent granted hereon all such modifications as reasonably and properly come within the scope of our contribution to the art.

We claim:

1. In a single-face station of a machine for producing corrugated cardboard, said station having a frame having a stand with side members enclosing an inner volume, said frame at one end of the volume supporting a pair of corrugating rollers and a pressure roller and at the opposite end of the volume having a door frame receiving a rear door provided with rails extending on the stand and supporting a gluing unit within the inner volume, the improvements comprising the door being formed by a panel with an outer dimension slightly smaller than the inner dimension of the door frame in which the panel is engaged, the periphery of the panel having a thickness different from the thickness of the door frame and being provided with peripheral sealing arrangements pressing on the inner periphery of the door frame, said rails being permanently connected to the inner portion of the panel and being arranged so as to slide on runners arranged on the stand of the frame of the station, said rails being provided at one end with stopping pieces designed to limit an opening motion of the door when the pieces come into contact with stops provided on the stand, said rails supporting the gluing unit, which rides on wheels on the rails, said door including interlocking means having at least one interlocking axle permanently secured on the door frame and hooks mounted on an inner surface of the panel for pivotable movement and to extend in a vertical plane, means for pivoting each hook in the vertical plane between the position engaging the axle and a position disengaged from the axle, and each hook having an inner notch with a front part having a curvature directed toward the panel.

2. In a single-face station according to claim 1, wherein tightening seals consist of brushes mounted on the periphery of the door in such a way that the bristles of the brushes will protrude outwardly from the edge of the door.

3. In a single-face station according to claim 1, wherein each hook has a lower front edge orientated obliquely downward in order to form a cam surface for automatically lifting the hook to pass over the interlocking axle as the door is closed, the curvature of the inner notch of the hook associated with the interlocking axle rendering it impossible for any lifting of the hook as long as pneumatic pressure exists in the inner volume of the single-face station.

4. In a single-face station according to claim 1, wherein there is at least a hook on each side of the door and the means for pivoting comprises a horizontal axle mounted in bearings on the inner surface of the panel forming the door, said horizontal axle being linked on each end to one of the hooks to impart rotary motion thereto.

5. In a single-face station according to claim 4, wherein the hooks are arranged in vertically-spaced pairs along each side of the door frame, the lower and upper hooks of each pair being connected by means of a vertical bar, the horizontal axle having an arm at each end, said arms being linked to each of the vertical bars so that rotational movement of the horizontal axle will be transmitted to each of the hooks.

6. In a single-face station according to claim 5, wherein the means for pivoting also includes a central arm having one end connected to the horizontal axle, the other end of the central arm being connected to a horizontal control lever, said control lever extending through an orifice in the door to enable actuation of the hooks from the exterior of the door.

* * * * *